United States Patent [19]

Helm

[11] 4,138,933

[45] Feb. 13, 1979

[54] APPARATUS FOR GUMMING AND FOLDING OPEN END ENVELOPES

[75] Inventor: Herbert W. Helm, Hollidaysburg, Pa.

[73] Assignee: F. L. Smithe Machine Company, Inc., Duncansville, Pa.

[21] Appl. No.: 798,383

[22] Filed: May 19, 1977

[51] Int. Cl.[2] ..... B31B 19/26

[52] U.S. Cl. ..... 93/61 R

[58] Field of Search ..... 43/61 R, 62, 63 R

[56] References Cited

U.S. PATENT DOCUMENTS

| | | | |
|---|---|---|---|
| 2,307,907 | 1/1943 | Becker | 93/62 |
| 3,641,883 | 2/1972 | Smithe et al. | 93/62 |
| 3,745,894 | 7/1973 | Helm | 93/61 R |

FOREIGN PATENT DOCUMENTS

| | | | |
|---|---|---|---|
| 2333244 | 1/1974 | Fed. Rep. of Germany | 93/61 R |
| 934941 | 8/1963 | United Kingdom | 93/62 |

*Primary Examiner*—Gerald A. Dost
*Assistant Examiner*—Paul A. Bell
*Attorney, Agent, or Firm*—Stanley J. Price, Jr.; John M. Adams; Wegner, Stellman, McCord, Wiles & Wool

[57] ABSTRACT

A transfer cylinder is rotatably mounted in a machine frame and is positioned in spaced parallel relation with a rotatable delivery cylinder. A side fold cylinder is positioned intermediate the transfer and delivery cylinders. The transfer cylinder conveys the envelope blank onto the periphery of the side fold cylinder. Rotation of the side fold cylinder with the envelope blank retained thereon folds the side flap and advances the folded envelope into engagement with the delivery cylinder. A gumming cylinder having an adhesive applicator portion is positioned adjacent the delivery cylinder and is operable to apply a strip of adhesive to the exposed bottom flap of the envelope blank as the blank is transferred from the delivery cylinder to the gumming cylinder. A selected amount of the adhesive is transferred from a reservoir by a roller to the surface of the adhesive applicator. The gumming cylinder rotates in timed relation to the delivery cylinder and in an opposite direction. The gummed envelope blank passes from the delivery cylinder and is engaged by a backup roller to transfer the envelope blank onto the upper surface of the gumming cylinder. The gumming cylinder feeds the envelope blank to a folding device that includes a plowshare and a formerblade. The bottom flap is folded and adhesively secured to the side flap while the top flap is folded in overlying relation with the side flap to close the open end of the envelope.

3 Claims, 3 Drawing Figures

12
22
24
26
28
30
32
34
36
38
40
42
44
14
16
18
20
10
46
48
50
51
52
53
54
55
56
57
58
59
60
61
62
66
68
70
72
74
76
78
80
82
84
86

APPARATUS FOR GUMMING AND FOLDING OPEN END ENVELOPES

BACKGROUND OF THE INVENTION

1. Field of the Invention

This invention relates to apparatus for making envelopes of the open end type and more particularly to an attachment to a closure flap folding apparatus that includes provision for gumming and folding an envelope blank to make open end envelopes.

2. Description of the Prior Art

Envelope making machines are known for folding the closure flap after the side and bottom flaps of the envelope blank have been folded and adhesively secured to the body portion as illustrated in U.S. Pat. No. 3,641,883. With other known conventional envelope making machines closure flap folding devices include belts, pressure rollers and the like, which apply forces upon the envelope while the envelope is conveyed through the closure flap folding cylinder. U.S. Pat. No. 1,943,985 illustrates a machine for making open end envelopes and includes a plurality of pressure rollers, belts, and extended conveying paths. Devices such as illustrated in U.S. Pat. No. 1,961,162 are also known for applying adhesive to envelope blanks for securing together the various folded flaps of the envelope blanks.

While it is known to make open end envelopes and apply adhesives to various flaps of the envelope, such devices are complex, expensive to manufacture and difficult to maintain in the manufacture of open end envelopes. There is need for apparatus that may be easily converted from closure flap folding operations to open end envelope making operations.

SUMMARY OF THE INVENTION

In accordance with the present invention there is provided apparatus for making envelopes of the open end type that includes a transfer cylinder for engaging and conveying an envelope blank having a pair of side flaps with one side flap being extended and a second side flap being folded, and a top flap and a bottom flap. A delivery cylinder is positioned in spaced relation to the transfer cylinder. The delivery cylinder is operable to receive the envelope blank with one side flap folded. A side fold cylinder is positioned parallel to the delivery cylinder between the delivery cylinder and the transfer cylinder. The side fold cylinder is operable to fold the side flap of the envelope blank along a score line and convey the folded envelope blank to the delivery cylinder. A gumming mechanism is positioned adjacent the delivery cylinder and is operable to apply a strip of adhesive material to the flap of the envelope blank as the blank is conveyed from the delivery cylinder. Means is associated with the gumming mechanism for transferring the envelope blank from the delivery cylinder to forwardly convey the envelope blank. A folding mechanism is positioned adjacent the gumming mechanism and is operable to fold the bottom flap in overlying relation with the folded side flaps so that the bottom flap is adhesively secured to the folded side flaps.

The transfer cylinder is rotated in timed relation with the delivery cylinder. The side fold cylinder is positioned between the transfer and delivery cylinders. A buckle plate is positioned above the side fold cylinder and is operable to receive the envelope blank while the side fold cylinder engages the side flap. Rotation of the side fold cylinder folds the extended side flap. The envelope with the side flaps folded is transferred onto the periphery of the delivery cylinder. The delivery cylinder rotates in a counterclockwise direction toward the gumming mechanism.

The gumming mechanism includes a cylinder positioned parallel to the delivery cylinder and is rotated on a shaft with an adhesive applicator nonrotatably mounted on the shaft. The adhesive applicator is positioned within a gap of the cylinder so that the periphery of the applicator, in the position of adhesive application, is tangent to the surface of the delivery cylinder. Rotation of the gumming cylinder shaft passes the applicator into contact with a transfer roller that is positioned within a reservoir of adhesive material below the gumming cylinder. Continued rotation of the gumming cylinder shaft transfers a selected amount of adhesive onto the surface of the applicator. As the gumming cylinder rotates in a clockwise direction the applicator applies the adhesive in a strip to the bottom flap of the envelope blank as the blank is transferred from the surface of the delivery cylinder to the surface of the gumming cylinder.

As the gummed envelope blank is transferred from the surface of the delivery cylinder to the surface of the gumming cylinder, a backup roller positioned tangent to the periphery of the gumming cylinder engages the envelope blank. Rotation of the backup roller and gumming cylinder in opposite directions advances the envelope blank on the surface of the gumming cylinder to the folding mechanism. The folding mechanism includes a plowshare device which picks up the leading edge of the envelope blank as it passes from the surface of the gumming cylinder. Driven rollers advance the envelope blank on the plowshare through a formerblade assembly. The formerblade assembly folds the top and bottom flaps in overlying relation with the folded side flap. The adhesive strip secures the bottom flap to the side flap. The top flap is folded to close the open end of the envelope. The folded envelope is conveyed by a spiral delivery mechanism from the folding device to a stack of formed envelopes.

Accordingly, the principal object of the present invention is to provide an envelope machine for making envelopes of the open end type.

A further object of the present invention is to provide an attachment for a conventional closure flap folding apparatus that includes devices for gumming and folding an envelope blank to make open end envelopes.

These and other objects of the present invention will be more completely disclosed and described in the following specification, the accompanying drawings and the appended claims.

DESCRIPTION OF THE PREFERRED EMBODIMENTS

Figures 1, 2, 3:
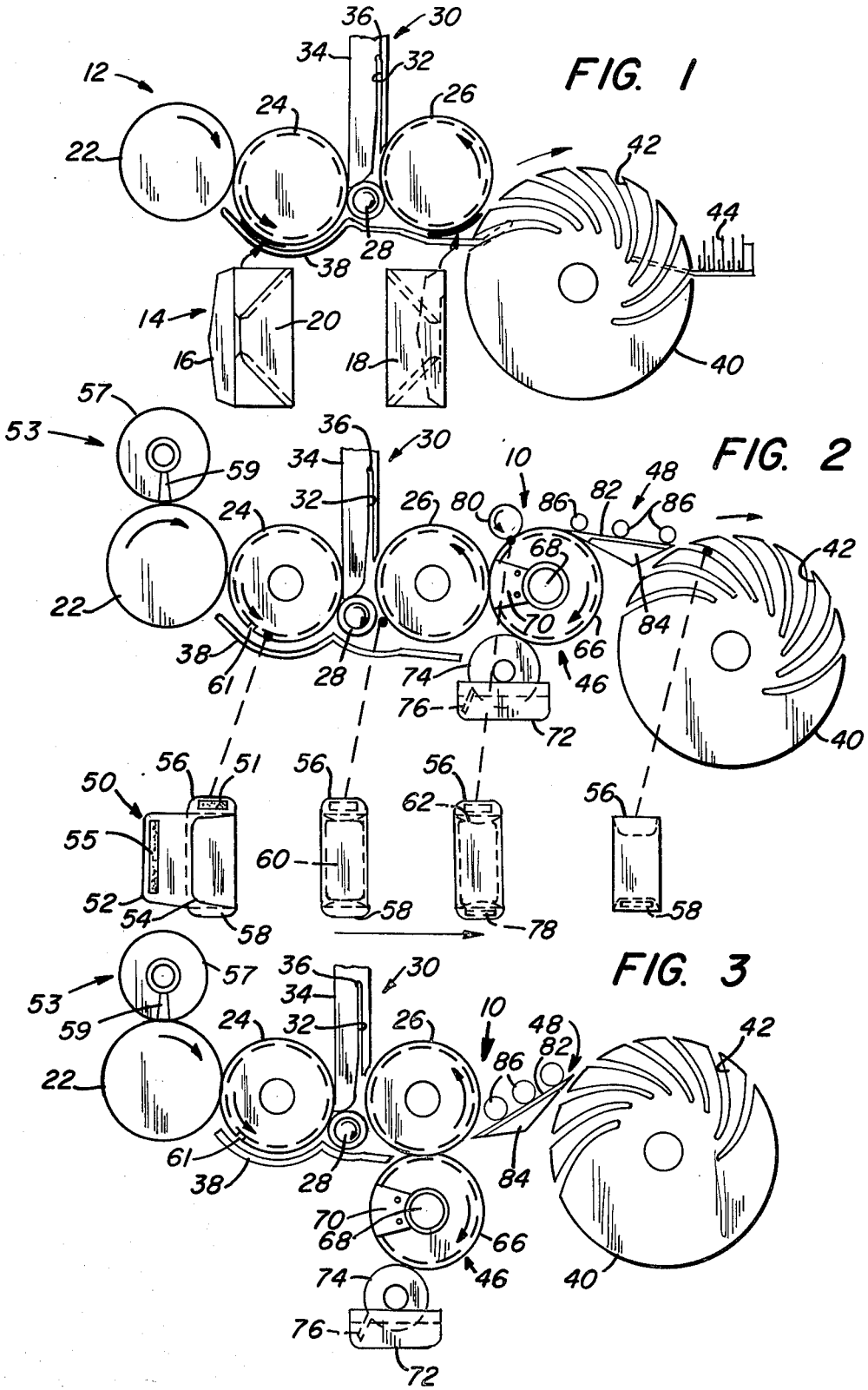
FIG. 1 is a schematic illustration in side elevation of conventional apparatus for folding the closure flap of a side seam envelope.
FIG. 2 is a schematic illustration in side elevation of an envelope machine for gumming and folding open end envelopes, illustrating the addition of a gummer and folder to the apparatus shown in FIG. 1.
FIG. 3 is a view similar to FIG. 2 of apparatus for gumming and folding open end envelopes, illustrating the gummer positioned beneath the delivery cylinder and the folder extending upwardly from the delivery cylinder to a gathering device.

Referring to the drawings, and particularly to FIGS. 2 and 3, there is illustrated a gumming and folding apparatus generally designated by the numeral 10 for use as an attachment to a conventional closure flap folding apparatus generally designated by the numeral 12 in FIG. 1 and described in greater detail in U.S. Pat. No. 3,641,883. The gumming and folding apparatus 10 is adaptable as an attachment to the apparatus 12 for performing the operations required to make an open end envelope that is customarily used for transferring currency at drive-in banks, handling garden and flower seeds and retaining travel tickets and the like, where a top flap is provided with or without a seal gum for sealing the envelope to retain the contents in the pocket of the envelope.

The apparatus 12 illustrated in FIG. 1 is operable to fold the closure flap of a conventional side seam envelope generally designated by the numeral 14 that includes a closure flap 16 and front and rear surfaces 18 and 20. A bottom flap folding cylinder 22 and a transfer cylinder 24 are positioned in parallel relation to each other and suitably mounted in a frame member (not shown). The cylinders 22 and 24 are drivingly connected to each other by a gearing mechanism described in U.S. Pat. No. 3,641,883. The cylinders 22 and 24 each include vacuum ports, also described in greater detail in the above mentioned patent, extending longitudinally on a portion of the cylinder periphery. The vacuum ports are connected in a known manner to a vacuum source. With this arrangement the bottom flap folding cylinder 22 rotates in a clockwise direction and cylinder 24 rotates in a counterclockwise direction to engage and transfer the envelope blank 14 from the cylinder 22 to the cylinder 24.

A delivery cylinder 26 is also mounted on the machine frame in parallel spaced relation to the transfer cylinder 24 and also includes pairs of vacuum ports similar to those of cylinders 22 and 24 on the periphery of the cylinder 26. A seal fold cylinder 28 is rotatably mounted on the machine frame between the transfer cylinder 24 and the delivery cylinder 26. A single row of vacuum ports on the periphery of the cylinder 28 is arranged to engage a portion of the envelope blank 14 and transfer the envelope blank to the delivery cylinder 26. The cylinders 26 and 28 are drivingly connected in timed relation as is well known in the art. The delivery cylinder 26 rotates in a counterclockwise direction and the seal fold cylinder 28 rotates in a clockwise direction.

A buckle plate generally designated by the numeral 30 is positioned above the seal fold cylinder 28 and has a longitudinal slot 32 and guide portion 34. The slot 32 has an end wall 36 against which the envelope blank 14 abuts when the envelope reverses direction. A guide bracket 38 is positioned beneath the cylinders 24 and 26 and a conventional delivery spiral 40 is rotatably positioned downstream of the delivery cylinder 26.

Folding of the closure flaps 16 in overlying relation with the rear surface 20 of the envelope 14 is accomplished by engaging the top surface 18 of envelope 14 by suction through the vacuum ports on the periphery of the bottom flap fold cylinder 22. Cylinder 22 rotates in a clockwise direction to transfer the rear surface 20 of the envelope into overlying relation with the vacuum ports on the transfer cylinder 24. The configuration of the envelope 14 at this stage of the operation is shown below the cylinder 24. The transfer cylinder 24 rotates in a counterclockwise direction to a location where the front edge of the envelope 14 is disengaged from the transfer cylinder 24 and is conveyed upwardly in the slot 32 of buckle plate 30. As the envelope blank moves up into the slot 32 the closure flap 16 is in overlying relation with the vacuum ports of the seal fold cylinder 28 so that the closure flap 16 is engaged to the cylinder 28. Rotation of the seal fold cylinder 28 in a clockwise direction folds the closure flap 16 along a score line.

The delivery cylinder 26 rotates in timed relation with the transfer cylinder 24 and the seal fold cylinder 28 to move the vacuum ports of the cylinder 26 into overlying relation with portions of the envelope front surface 18 and move the envelope 14 downwardly in the slot 32 and between the delivery cylinder 26 and the seal fold cylinder 28 with the folded closure flap 16 forming the leading edge of the envelope 14. Thereafter, the envelope is transferred by the delivery cylinder 26 to the delivery spiral 40 where the envelope is transferred into an arcuate receiving slot 42 for delivery to a stack 44.

The above described apparatus 12 for folding the closure flap of a conventional side seam envelope is readily adaptable by the addition of a gumming apparatus generally designated by the numeral 46 and a folding apparatus generally designated by the numeral 48 in FIG. 2 for making envelopes of the open end type. The open end envelope is made from an envelope blank 50 that includes side flaps 52 and 54 and top and bottom flaps 56 and 58 which when folded in the manner hereinafter described form an enclosure 60 having an open end 62 adjacent the top flap 56 which may be folded in overlying relation with the folded side flap 52 or tucked into the open end 62 to thereby close the open end 62.

The conversion of the closure flap folding apparatus 12 illustrated in FIG. 1 to the gumming and folding apparatus illustrated in FIG. 2 is accomplished by moving the delivery spiral 40 downstream of the delivery cylinder 26. An adhesive applicator cylinder 66 is positioned in the gap between the delivery spiral 40 and the delivery cylinder 26. The cylinder 66 is rotatably mounted in the machine frame on a shaft 68 to position the cylinder 66 in tangent parallel relation with the delivery cylinder 26. The cylinder 66 includes a gap in the periphery thereof and an adhesive applicator such as a transfer blade 70 is nonrotatably mounted on the shaft 68 and positioned within the gap of the cylinder 66. The shaft 68 rotates the cylinder 66 and the blade 70 in a clockwise direction opposite to the direction of rotation of the delivery cylinder 26. The cylinder 66 rotates in timed relation with the delivery cylinder 26 to move the adhesive applicator 70 into contact with a portion of the periphery of the delivery cylinder 26.

An adhesive reservoir 72 is positioned below cylinder 66 and an adhesive transfer roller 74 is rotatably positioned within the reservoir 72 so that a continuous supply of sealing adhesive is applied to the surface of the transfer roller 74. A scraper blade 76 is retained in the reservoir 72 in contact with the periphery of the roller 74 to remove excess adhesive therefrom. The adhesive material is transferred from the surface of the roller 74 to the surface of the adhesive applicator 70. As the shaft 68 rotates the adhesive applicator in a clockwise direction, the envelopes, engaged by suction to the periphery of the delivery cylinder 26, are conveyed between the cylinders 26 and 66. The rotation of the applicator 70 is timed relative to rotation of the cylinder 26 so that the applicator 70 applies a strip of adhesive to a portion of the bottom flap 58.

An adhesive backup roller 80 is rotatably positioned above and tangent to the cylinder 66. The roller 88 is rotated in a counter clockwise direction. The folding device 48 extends outwardly from the periphery of the cylinder 66 opposite the roller 80 and is operable to fold the bottom flap 58 and top flap 56 and convey the folded envelope 50 into one of the receiving slots 42 of the delivery spiral 40. The folding device 48 includes a conventional plowshare 82 and a formerblade 84. A plurality of driven rollers 86 is operable to engage and convey the envelopes 50 on the surface of the plowshare 82 into the receiving slots 42.

In operation prior to delivery of the open end envelope blank 50 to the cylinder 22, adhesive material is applied to the top flap 56 and dried to form an adhesive strip 51. For folding a conventional side seam envelope, as illustrated in FIG. 1, the cylinder 22 operates as a bottom flap folding cylinder; whereas, in the folding of an open end envelope the cylinder 22 operates as a side flap folding cylinder. Thus, the cylinder 22 folds the side flap 54.

A second gumming apparatus generally designated by the numeral 53 is positioned adjacent the side flap cylinder 22 and is operable to apply an adhesive strip 55 to the side flap 52. The gumming apparatus 53 includes a cylinder 57 positioned tangent to the cylinder 22. The cylinder 57 is rotated in timed relation with cylinder 22 to move an adhesive applicator 59 into contact with side flap 52 and transfer thereto adhesive material that is supplied to the applicator 59 from a source (not shown).

The envelope blank 50 with the side flap 52 extended and the side flap 54 folded is engaged by suction to the periphery of the transfer cylinder 24. The transfer cylinder, as above discussed, for the closure flap folding apparatus 12 rotates in a counterclockwise direction. The transfer cylinder 24, as illustrated in FIG. 2, includes a longitudinal recess 61 positioned on the periphery of the cylinder. The envelope blank 50 is transferred to the cylinder 24 with the adhesive strip 55 of side flap 52 positioned in overlying relation with recess 61. This ensures that the wet adhesive material of strip 55 is not transferred to the periphery of the cylinder 24.

The envelope 50 is conveyed from the surface of transfer cylinder 24 upwardly into the slot 32 of the buckle plate 30. As the envelope blank moves up into the slot 32, the side flap 52 is engaged by suction on the periphery of the cylinder 28 to secure the envelope 50 to the cylinder 28 as the cylinder rotates in a clockwise direction. In the embodiment illustrated in FIGS. 2 and 3, the cylinder 28 operates as a second side fold cylinder. Thus, rotation of the side fold cylinder 28 in a clockwise direction folds the side flap 52 in overlying relation with side flap 54 and becomes adhered thereto by contact of the strip 55 with the side flap 54.

With the delivery cylinder 26 rotating in timed relation with the transfer cylinder 24 and side fold cylinder 28 the envelope 50 moves downwardly in the slot between the side fold cylinder 28 and the delivery cylinder 26. With this arrangement the folded side flap 52 forms the leading edge of the envelope 50. Rotation of the delivery cylinder 26 in a counterclockwise direction conveys the envelope 50, engaged to the surface of the cylinder 26, into contact with the adhesive applicator 70 which rotates in timed relation with the cylinder 26 so that a strip of adhesive 78 is applied to the bottom flap 58. The envelope 50, engaged by suction on the periphery of the cylinder 26, passes into contact with the rotating adhesive applicator 70 on the shift 68. As the envelope moves beyond the point of tangency between the cylinder 26 and the applicator 70, the envelope is released from engagement with the periphery of the cylinder 26 and the leading edge of the envelope passes between the roller 80 and the cylinder 66. In this manner the envelope is transferred onto the surface of cylinder 66.

The cylinder 66 rotates in a clockwise direction to transfer the envelope to the folding device 48. As the cylinder 66 continues to rotate, the plowshare 82 engages the leading edge of the envelope blank and directs the envelope outwardly from the surface of cylinder 66 into frictional engagement with the rollers 86 and also into contact with the formerblade assembly 84. The formerblade assembly 84 folds the top flap 56 and bottom flap 58 along score lines in overlying relation with the folded side flap 52. The folding operation seals the bottom flap 58 to the folded side flap 52. The top flap 56 is also folded in overlying relation with the folded side flap 52 to close the open end 62 and, in turn, the pocket 60 without adhering the top flap 56 to the side flap 52. The folded open end envelope 50 is conveyed from the plowshare 82 by rotation of the rollers 86 into one of the slots 42 of the delivery spiral 40, which delivers the folded envelope to a stack.

A further embodiment of the gumming and folding apparatus 10 of the present invention is illustrated in FIG. 3. The gumming device 46 is moved to a position below the delivery cylinder 26. The shaft 68 is rotatably supported in the machine frame below the cylinder 26 so that the adhesive cylinder 66 is positioned parallel to and below the delivery cylinder 26. The cylinder 66 is tangent to the cylinder 26 so that upon counterclockwise rotation of the cylinder 66 the adhesive applicator 70 moves into and out of contact with the envelope blanks on cylinder 26 at the point of tangency between cylinders 26 and 66.

The folding device 48 is positioned with the leading edge of the plowshare 82 positioned between the cylinders 26 and 66 adjacent the point of tangency thereof. The plowshare extends upwardly and the rollers 86 are positioned above on the elevated surface of the plowshare 82. The elevated end of the plowshare 82 is positioned adjacent the delivery spiral 40 for conveying the envelopes 50 into one of the slots 42. The envelope 50 is engaged by suction to the periphery of the delivery cylinder 26 and the folded side flap 52 forms the leading edge of the envelope. Rotation of the delivery cylinder 26 in a counterclockwise direction moves the bottom flap 58 into contact with the adhesive applicator 70 rotating in a clockwise direction so that the adhesive strip 78 is applied to the bottom flap 58.

From the point of tangency of the cylinders 26 and 66 the envelope 50 with the side flap 52 folded is conveyed between the cylinders into the folding device 48. The plowshare 82 directs the envelope into the formerblade assembly 84. As rollers 86 convey the envelope along the elevated plowshare 82, the formerblade assembly 84 folds the top and bottom flaps 56 and 58. The bottom flap 58 is adhered to the folded side flap 52 by the adhesive strip 78. The rollers 86 advance the folded envelope into one of the slots 42 of the delivery spiral 40. Thus it will be apparent from the present invention that a conventional machine for folding the closure flap of a conventional side seam envelope is readily converted to a machine for making envelopes of the open end type by the attachment of the gumming device 46 and the folding device 48.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A method for converting a side seam envelope machine to an open end envelope machine in which said side seam envelope machine includes a transfer cylinder for engaging and conveying a side seam envelope with an open closure flap, a delivery cylinder positioned in spaced relation to said transfer cylinder and a closure flap folding cylinder positioned between said transfer cylinder and said delivery cylinder, said delivery cylinder and said closure flap folding cylinder arranged to fold said closure flap and said delivery cylinder arranged to transfer said side seam envelope with said closure flap folded to a delivery device comprising, moving said delivery device laterally to provide a space between said delivery cylinder and said delivery device, positioning a gumming device adjacent to said delivery cylinder, said gumming device arranged to apply a strip of adhesive to the bottom flap of a side seam envelope, and positioning a folding means in said space between said delivery cylinder and said delivery device, said folding means arranged to fold said bottom flap of a side seam envelope into overlying relation with said folded side flaps.

2. A method for converting a side seam envelope machine to an open end envelope machine as set forth in claim 18 which includes, positioning said gumming device in said space between said delivery cylinder and said delivery device with said folding means positioned between said gumming device and said folding means.

3. A method for converting a side seam envelope machine to an open end envelope machine as set forth in claim 1 which includes, positioning said gumming device below said delivery cylinder.

* * * * *